United States Patent [19]

Collopy

[11] Patent Number: 4,581,854

[45] Date of Patent: Apr. 15, 1986

[54] VALVE GRINDING APPARATUS

[76] Inventor: Michael D. Collopy, 915 Ave. E, Galveston, Tex. 77550

[21] Appl. No.: 665,670

[22] Filed: Oct. 29, 1984

[51] Int. Cl.[4] ..... B24B 15/02; B24B 15/08

[52] U.S. Cl. ..... 51/29; 51/216 T; 51/217 T; 51/241 VS

[58] Field of Search ..... 51/241 R, 241 VS, 241 S, 51/29, 216 T, 217 T, 131.1, 134.5 R

[56] References Cited

U.S. PATENT DOCUMENTS

| | | | |
|---|---|---|---|
| 1,502,015 | 7/1924 | Bishir | 51/29 |
| 1,951,796 | 3/1934 | Kulp et al. | 51/29 |
| 2,576,333 | 11/1951 | Earll | 51/29 |
| 2,908,120 | 10/1959 | Jensen | 51/241 VS |

FOREIGN PATENT DOCUMENTS

| | | | |
|---|---|---|---|
| 717470 | 2/1942 | Fed. Rep. of Germany . | |
| 2624938 | 12/1976 | Fed. Rep. of Germany | 51/241 VS |

*Primary Examiner*—Roscoe V. Parker

[57] ABSTRACT

Apparatus for grinding a valve seat of an internal combustion engine using a conventional handheld power drill. A tubular housing provides a shoulder for aligning the tool with the valve and seat during operation. An inner member is concentrically disposed in the tubular housing and extends outwardly for attachment to the chuck of the handheld power drill to rotate the apparatus and attached valve during the grinding operations. A flexible portion of the inner member compensates for angular misalignment between the valve and seat in the handheld drill. A spring is concentrically mounted about the inner member between the tubular housing and an adjustable spring retainer for pulling the valve into contact with the seat with a preselected grinding force. Preferably, the valve is rotated in alternating directions during the grinding operation to insure proper seating.

1 Claim, 3 Drawing Figures

FIG. 1
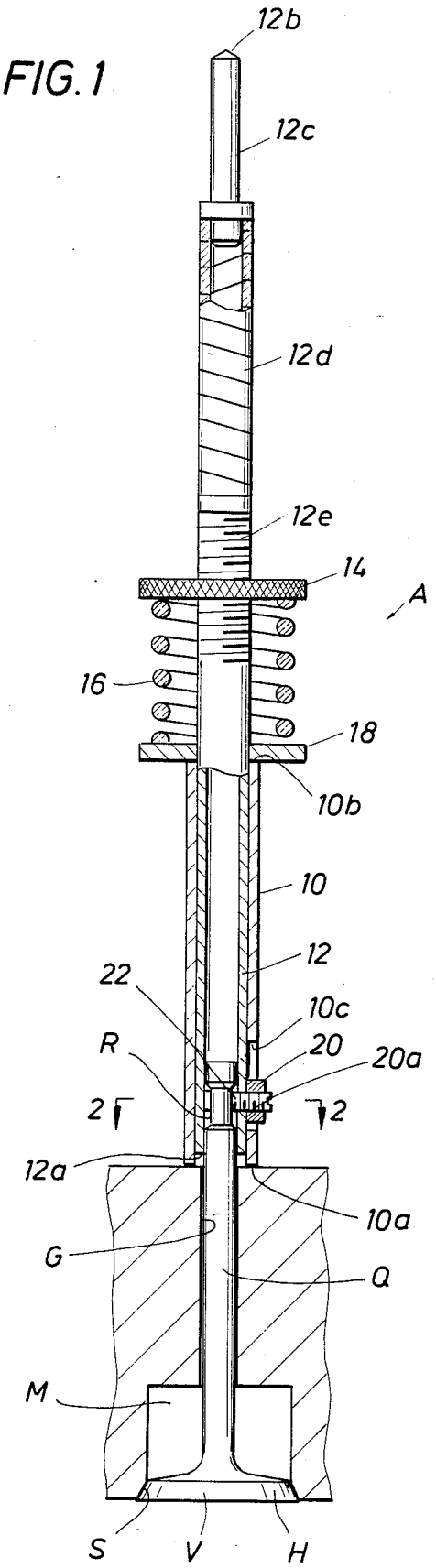
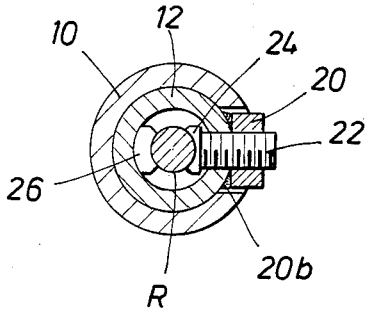
FIG. 2
FIG. 3
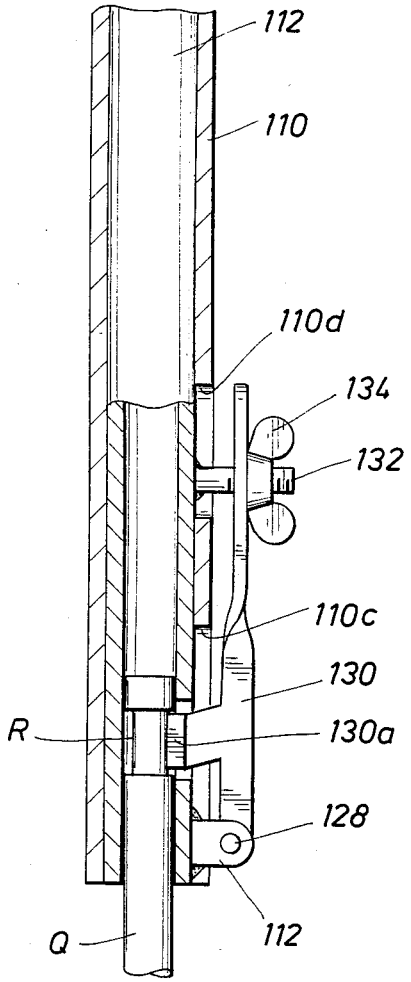

VALVE GRINDING APPARATUS

BACKGROUND OF THE INVENTION

1. Field of the Invention

This invention relates generally to apparatus for metal grinding and more particularly to apparatus for grinding valves within the valve seats of internal combustion engine.

2. Background Art

Proper operation of internal combustion engines requires seating or sealing of the inlet and outlet valves for the appropriate time duration in the cycle of operation. Failure to properly seal may not only result in inefficient engine operation, but may also result in damage to the engine itself.

Proper maintenance of an internal combustion engine requires periodic reseating of the engine valves. This is normally accomplished by rotating the valve while in contact the valve seat in the presence of an abrasive valve grinding compound. Numerous apparatus have been developed to perform such valve grinding operations. The prior apparatus presently known to Applicant is considered below.

U.S. Pat. No. 2,576,333 to Earll discloses a valve and seat grinding device for an internal combustion engine. A rotatable pulley rotates the valve and operates the two compression springs 26 and 27 which actually move the valve either into grinding engagement with the seat or space the valve from the seat to permit visual inspection. The direction of valve rotation controls the direction of axially movement of the valve and therefore the direction of grinding is not reversible. The non-rotating spring housing formed by the cylinder 16 and cap 17 is held against the manifold flange during operation to properly align the valve and seat.

Jensen U.S. Pat. No. 2,908,120 discloses a grinding apparatus for flow control valves in which the spring force may be adjusted. The grinding wheel is rotated either by hand or a drive motor. A mounting bracket is used to secure the apparatus to the valve house.

German Pat. No. 717,470 also discloses a manually operated valve grinding device having a chuck for securing with the valve stem.

U.S. Pat. Nos. 1,502,005 to Bishir and 1,951,796 to Kulp et al. disclose valve grinding apparatus.

The Bishir apparatus is designed for use on overhead valves and requires removal of the valve and seat case from the engine. The Kulp apparatus provides a guide bearing for centering the valve during grinding.

SUMMARY OF THE INVENTION

The present invention relates to an apparatus for grinding the valve and valve seats for internal combustion engines. The apparatus is adapted for attachment to a chuck of a conventional handheld electric or pneumatic drill which rotates the engine valve member connected to apparatus. A tubular housing operably positions the apparatus adjacent the valve and seat to be ground. Rotatably disposed within the tubular housing is the valve securing member. An adjustable spring biases the valve securing member relative to the fixed housing to provide the suitable valve grinding force. A portion of the valve securing member is formed by a bias spring to compensate for axial misalignment of the electric drill and the tubular housing during operation.

BRIEF DESCRIPTION OF THE DRAWINGS

FIG. 1 is a side view, partially in section of the valve and seat of an internal combustion engine with the valve grinding apparatus of the present invention operably positioned therewith;

FIG. 2 is a view taken along line 2—2 of FIG. 1; and

FIG. 3 is a view of an alternate embodiment for securing the apparatus with the valve.

DESCRIPTION OF THE PREFERRED EMBODIMENT

The valve seat grinding apparatus of the present invention, generally designated A in FIG. 1, is illustrated positioned for operation with an internal combustion engine E. The reciprocating engine valve V is illustrated in the closed or seated position for sealing with the fixed annular seat S formed by the block or engine E. Movement of the valve V from the seat S enables communication between the cylinder (not illustrated) and either the inlet or outlet manifold M. The valve V includes an enlarged circular head H which seals with the seat S and an rod-like stem Q which extends through a reciprocating movement guide opening G formed in the engine E. An annular recess R is formed in the valve stems Q exteriorly of the engine E.

The valve grinding apparatus A of present invention includes a tubular outer housing 10 having a first end 10*a* disposed adjacent the engine E and a second end 10*b*. The first end 10*a* provides an annular shoulder for engaging the internal combustion engine to operably position and guide the operation of the apparatus A relative to the valve B and Seat S during the valve grinding operation.

The apparatus A further includes an elongated central member 12 which is concentrically disposed within the tubular housing 10 and extends therefrom beyond the second end 10*b* of the housing 10. The elongated central member 12 is provided with a first end operably disposed within the tubular housing 10 and a second end 12*b* disposed outwardly of the tubular housing 10. The portion adjacent the second end 12*b* of the elongated central member 12 is a rod like portion 12*c* adapted to be secured within a chuck (not illustrated) of a conventional hand held electric or pneumatic powered drill. Such hand held power drills are well known and commercially available from local hardware stores.

Located adjacent the chuck securing portion 12*c* is a flex stiff spring portion 12*d* which is secured, preferably by welding, to the chuck gripping portion 12*c*. The spring 12*d* compensates for axial misalignment between the hand held drill and the valve stem Q during valve grinding operations. Adjacent the flex spring portion 12*d* and secured thereto by welding is a helically threaded portion 12*e*. For purposes of assembly, the threaded portion 12*e* extends to the first end 12*a* of the central member 12. Mounted on the thread portion 12*e* is a finger adjustable spring retainer 14. A coil spring 16 is concentrically mounted about the central member 12 between the adjustable spring retainer 14 and the outer housing 10. In the illustrated embodiment, a retainer washer 18 is utilized for transmitting the urging of the spring 16 to the outer housing 10 with it being understood that the spring size may be selected to fit tightly around the central member 12 and thereby avoid the need for the spring flange 18. The force of the urging of the spring 16 between the adjustable flange 14 and the flange 18 is of course controlled by the position of the adjustable retainer 14.

The threaded portion 12*e* of the central member 12 is preferably a tubular member adapted to concentrically fit about the protruding part of the valve stem Q.

As best illustrated in FIG. 1, the outer housing 10 is provided with an elongated slot 10*c* adjacent the first end 10*a*. The slot provides clearance to enable longitudinal movement between the inner or central member 12 in the housing 10. Disposed within the slot 10*c* is conventional nut 20 which is secured to the inner member 12. The nut 20 has conventional opening 20*a* for receiving a valve stem securing threaded bolt 22.

As best illustrated in FIG. 2, the nut 20 is secured to the central member 12 by suitable means such as brazing or welding at 20*b*. Rotational movement of the threaded bolt 22 will move the valve engaging latch 24 from the recess R of the valve stem Q when desired. Likewise, tightening of the threaded member 22 will secure the valve stem Q with the apparatus A. To maintain the valve stem in concentric relationship with the apparatus A a centering guide 26 may be employed.

An alternate form of the valve stem latching mechanism is illustrated in FIG. 3. In this embodiment, reference characters have been increased by a factor of 100 to show identical parts. The housing 110 is provided with a pair of slots 110*c* and 110*d* which provide for relative longitudinal movement between the housing 110 and the inner member 112. Disposed within the elongated opening 110*c* is an outwardly extending mounting lug 112*a* which is secured to the outer surface of the inner member 112. A pivot pen 128 secures the pivot mounting lug 112 to a lever 130. The lever 130 has an inwarding projected valve locking portion 130*a* which is received within the radial annular recess R of the valve stem Q for securing the apparatus A with the valve V.

To secure the lever arm in the lock position a threaded bolt member 132 is secured to the inner member 112 and extends outward through opening 110*d*. A suitable wing nut 134 is used to retain the lever arm 130 in a locked position during grinding operations.

Use and Operation

In the use and operation of the present invention, the apparatus A is assembled in the manner illustrated. A small handheld motorized drill is attached by a chuck to the portion 120 of the rotatable inner member 12 for effecting its rotation. A valve grinding compound is applied to the valve V and the valve seat S with the valve located in the seat S of the engine E.

The valve stem Q is then locked to the apparatus A using the securing mechanism for securing the valve stem Q with the inner member 12 for rotation of the valve stem Q. With the valve stem Q attached, the spring retainer 14 is rotated on the threaded port to adjust the spring force for urging the inner member 12 towards the drill and pulling the valve head H into engagement with the seat S. With proper spring 16 tension urging of the valve V on the seat S, the drill motor is operated to rotate the valve for grinding the valve and seat.

After rotating for approximately 45 seconds the rotation should be stopped and the valve seat inspected for proper seating. Preferably, the direction of rotation is reversed or alternated for the next 45 second cycle of operation which is sequentially repeated until the valve V is properly seated.

The apparatus A is used to polish or grind the annular seat S during engine repair or maintenance operations without the necessity of removing the engine E from the vehicle engine compartment. The apparatus A is relatively inexpensive to make and is easy to use. The disclosed valve and seat grinding apparatus is portable, compact and may be employed with the valves and seats of almost any type of internal combustion. The apparatus A also quickens the grinding operation by compensating for angular misalignment and in providing a constant urging of the valve V on the seat S.

The foregoing disclosure and description of the invention are illustrative and explanatory thereof, and various changes in the size, shape and materials, as well as in the details of the illustrated construction may be made without departing from the spirit of the invention.

What is claimed is:

1. Apparatus for grinding a valve seat of an internal combustion engine using a conventional handheld power drill, including:

tubular housing having a first end and a second end, said first end forming an annular shoulder for engaging the internal combustion engine to operably position the tubular housing relative to the valve seat;

an elongated central member disposed in said tubular housing extending therefrom beyond said second end of said tubular housing, said elongated central member having a first end operably disposed within said tubular housing;

said elongated central member having a second end with a portion of said elongated central member adjacent said second end adapted to be secured to a chuck of a handheld power drill;

said central elongated member having a flexible portion disposed adjacent said portion adapted to be secured to a chuck to enable angular misalignment between said handheld power drill and said first end of said elongated central member;

said central elongated member having an external helical threaded portion disposed adjacent said second end of said tubular housing;

a spring retainer having internal helical thread for mounting on said threaded portion of said central elongated member;

a spring concentrically disposed exteriorly of said central elongated member between said spring retainer and said second end of said tubular housing for urging said elongated central member towards said handheld drill; and means for securing said first end of said elongated central member with said valve stem to effect rotation of said valve with the elongated central member while urging valve towards said second end of tubular housing with the spring.

* * * * *